United States Patent [19]

Stein

[11] Patent Number: 4,533,045

[45] Date of Patent: Aug. 6, 1985

[54] TOOTHBRUSH HOLDER AND PRESERVER

[76] Inventor: Patrick G. Stein, 1153 Bowness Rd. NW., Calgary, Alberta, Canada, T2N 3J6

[21] Appl. No.: 671,499

[22] Filed: Nov. 15, 1984

[51] Int. Cl.[3] ..... B65D 83/10

[52] U.S. Cl. ..... 206/362.3; 206/362.4

[58] Field of Search ..... 206/362.1, 362.2, 362.3, 206/362.4

[30] Foreign Application Priority Data

Apr. 11, 1984 [CA] Canada ..... 451758

[56] References Cited

U.S. PATENT DOCUMENTS

| | | | |
|---|---|---|---|
| 1,827,654 | 10/1931 | Harper | 206/362.3 |
| 1,931,293 | 10/1933 | Morck | 206/362.4 |
| 2,897,531 | 8/1959 | Calabrese | 206/362.3 |
| 2,947,412 | 8/1960 | Tupper | 206/362.3 |

*Primary Examiner*—Joseph Man-Fu Moy

*Attorney, Agent, or Firm*—Gipple & Hale

[57] ABSTRACT

A holder for a toothbrush is provided which includes a first substantially rectangular side wall, a second substantially rectangular side wall sharing a first common longitudinal edge with the first side wall and angulated thereto, said second side wall being wider than said first side wall and a third substantially rectangular side wall sharing a second common longitudinal edge with said second side wall, and extending substantially normal thereto. The first and second side walls define therebetween a wedge-shaped chamber adapted to receive the bristles of a toothbrush and to bias the sides of the bristles inwardly while said third side wall defines retaining means for retaining the toothbrush in the holder. The bristles, upon insertion into the holder form a wedge-shaped mass whereby they retain their natural operative direction without deformation during drying thereof.

14 Claims, 5 Drawing Figures

TOOTHBRUSH HOLDER AND PRESERVER

The present invention relates to the field of toothbrush holders.

If a toothbrush is successively used, rinsed and left to dry in an unprotected state, the bristles of the toothbrush will rapidly spread apart, and the toothbrush will consequently lose its efficacy. Accordingly, it is very desirable to provide a means by which this "bristle spread" can be prevented, and thereby lengthen the useful life of a toothbrush.

One device which has been suggested for the foregoing purpose is shown in Canadian Pat. No. 615,707 issued Mar. 7, 1961 to Colabrose. This comprises a clamp which slides onto the head of a toothbrush. The clamp has sides which press inwardly on the bristles of the toothbrush. However, in this device, the bristles of the toothbrush protrude from the clamp, and it can therefore be seen that this device will only partially prevent bristle spread, and the bristles will, using this device, still tend to spread where they protrude.

Another suggested device is shown in Canadian Pat. No. 771,338 issued Nov. 14, 1967 to Wexler. This device comprises a toothbrush cover having a pair of notches on its sides, into which the head of a toothbrush can be slid. However, it is clear that this device will only be useful if a toothbrush with edges corresponding in width and shape to the notches is used with it. Accordingly, the device proposed by Wexler cannot find general application to the entire range of toothbrushes on the market and available to the consuming public.

It is the object of the present invention to overcome the disadvantage associated with prior toothbrush covers and provide an inexpensive toothbrush cover which can be used with substantially all existing toothbrushes, to prevent bristle spread in toothbrushes in which it is used.

In one broad aspect, the present invention relates to a holder for a toothbrush including a first substantially rectangular side wall, a second substantially rectangular side wall sharing a first common longitudinal edge with the first side wall and angulated thereto, said second side wall being wider than said first side wall, a third substantially rectangular side wall sharing a second common longitudinal edge with said second side wall, and extending substantially normal thereto, said first and second side walls defining therebetween a chamber adapted to receive the bristles of said toothbrush and to bias the sides of said bristles inwardly whilst said third side wall defines retaining means for retaining said toothbrush in said holder, said bristles upon insertion into said holder thereby forming a wedge-shaped mass whereby they retain their natural operative direction without deformation during drying thereof.

In another broad aspect, the present invention relates to a one-piece blank adapted to form a toothbrush holder including a plurality of interconnected panels selected ones of which, when the blank is formed to provide said holder, define substantially rectangular first, second and third side walls, each having mutually opposed top and bottom edges and a pair of mutually opposed marginal side edges, said second panel being wider than said first panel and sharing a first common side edge therewith and said second and third panels sharing a second common side edge; said first and second panels, upon bending along said first common side edge, forming a wedge-shaped chamber adapted to receive the bristles of a toothbrush and to bias the sides of said bristles inwardly so as to retain them in a wedge-shaped mass during drying thereof; and said second and third panels, upon bending along said second common side edge, forming a retaining wall extending normal to said second panel and adapted slidably to engage the head of a toothbrush and thereby retain the latter in said holder.

The invention is illustrated, by way of example, in the accompanying drawings in which.

Figures 1, 2:
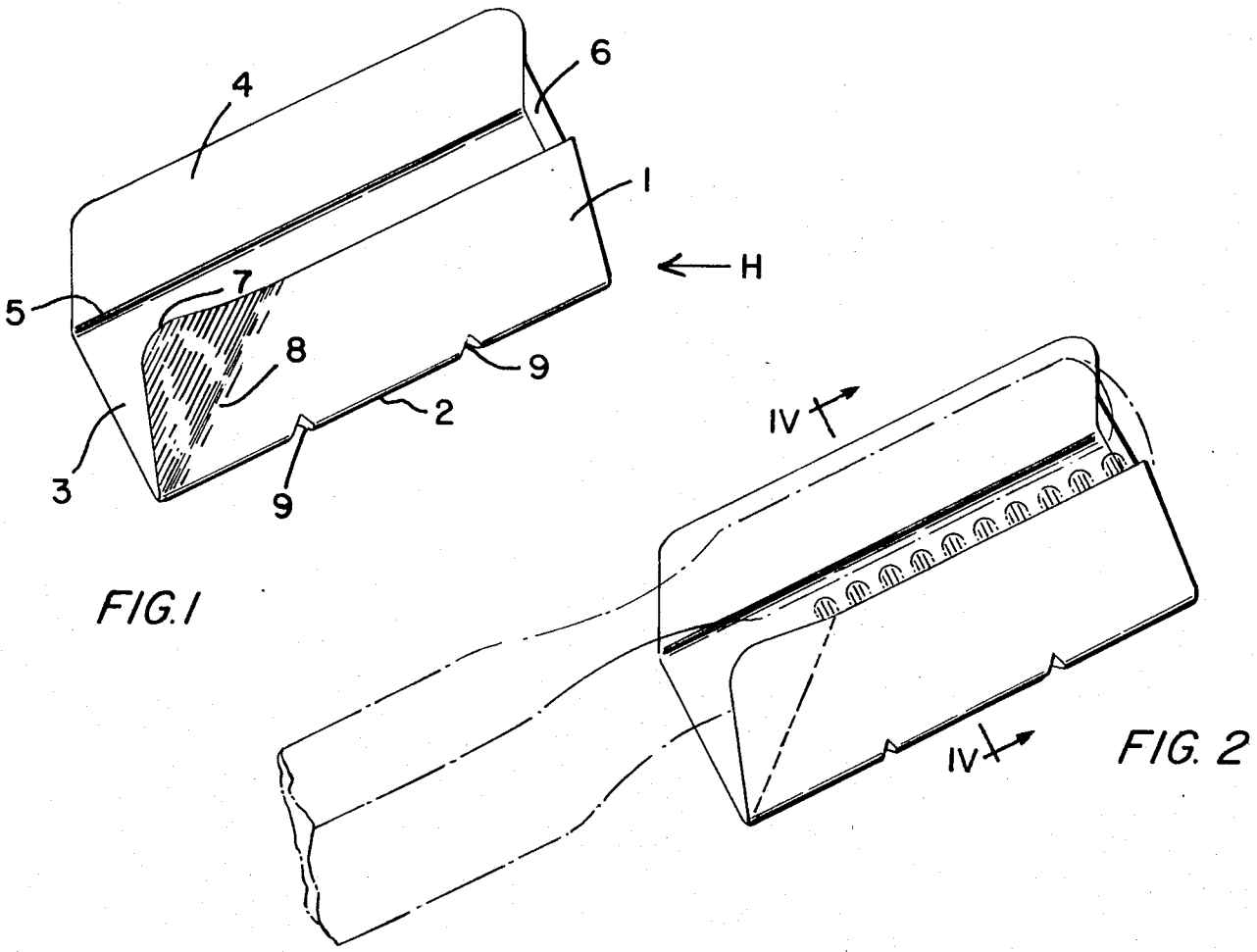
FIG. 1 is a perspective view of the toothbrush holder of the present invention.
FIG. 2 is a perspective view of the toothbrush holder with a toothbrush inserted therein.

Referring to the drawings and specifically to FIG. 1, the toothbrush holder, illustrated generally by the letter H, of the present invention includes a first rectangular side wall 1 which is joined along one of its longitudinal edges 2 to a second rectangular side wall 3. First side wall 1 and second side wall 2 are angulated with respect to one another at between 15° and 65°, preferably around 30°. Second side wall 3 is wider than first side wall 1, and is joined to third rectangular side wall 4 along edge 5. Third side wall 4 extends normal to the second side wall 3. An end wall 6 is provided at one end of the toothbrush holder H, and extends normal to the side wall. End wall 6 is joined to second side wall 3. Alternatively, the end wall 6 may be joined to the first side wall, or the third side wall 4.

One corner 7 of the first side wall 1 is bent upwardly approximately 1O° along an imaginary line 8 on the first side wall, to form a lip in the open end of the toothbrush holder, which lip facilitates insertion of a toothbrush into the toothbrush holder. The angle of upward bending of this lip may be from 5° to 15°.

A pair of apertures 9 are formed at the juncture of the first and second side walls 1, 3, along the common edge 2 thereof. These apertures, which may in practice number one or more, act as vents to allow egress of excess water which accumulates in the toothbrush holder H as a result of rinsing the toothbrush and also allow air to enter the toothbrush holder H, thereby assisting in the drying of the toothbrush.

Referring to FIG. 2, the mode of insertion of a typical toothbrush (illustrated in phantom) into the toothbrush holder H illustated in FIG. 1 is shown. It may be seen that as the toothbrush is inserted, with its bristles between the first and second side walls 1, 3, the toothbrush is retained in the toothbrush holder H by the third side wall 4, which comes into sliding contact with the head of the toothbrush. The extent of insertion of the toothbrush is limited by the end wall 6.

It may be seen that the width of the bristle area of the toothbrush is greater than the width of the wedge-shaped chamber defined by the first and second side walls 1, 3. However, as a toothbrush is inserted into the toothbrush holder H, its bristles first contact the upturned lip 7 of the first side wall. As the toothbrush is further inserted, the lip 7 will press the sides of bristles of the toothbrush inwardly, so that as they slide into the said chamber, they have already been pressed into the wedge-shape necessary to fit into the chamber. Tearing or distortion of bristles during insertion of a toothbrush into the toothbrush holder is thereby substantially eliminated.

When the toothbrush has been fully inserted into the toothbrush holder H of the present invention, its bristles will be pressed inwardly by the first and second side walls 1, 3, so that as the bristles dry, they will tend not to spread apart.

Figure 3:
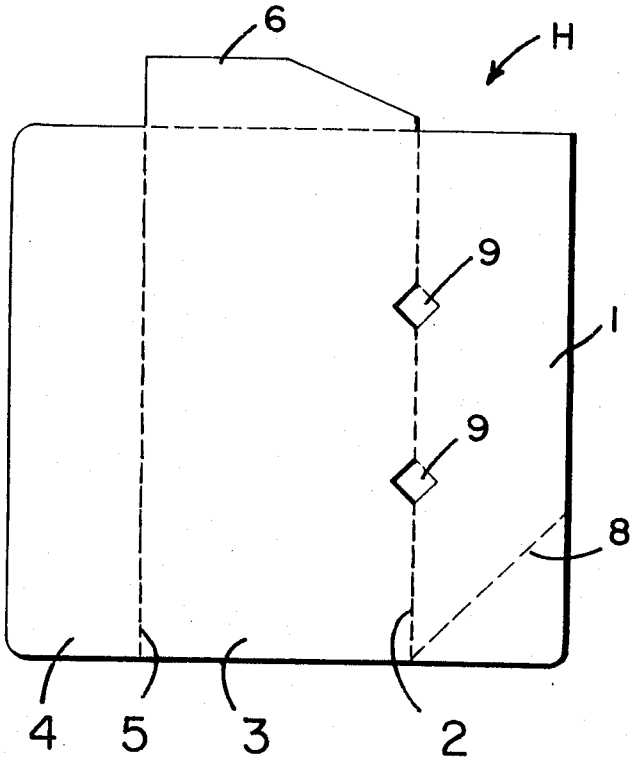
FIG. 3 is a plan view of a one-piece blank adapted to form the toothbrush holder of FIG. 1.

Referring to FIG. 3, a blank for manufacturing the toothbrush holder H of the present invention can be formed from any suitable material, such as aluminum, tin or stainless steel, or sheets of thermoplastic material, thereby eliminating the need for expensive injection molding techniques. The range of suitable thermoplastics includes both high and low density polyethylene, or polypropylene, or acrylonitrile-butadiene-styrene (A.B.S. resin), rubber-modified polystyrene, PVC, cellulose acetate, or cellulose acetate butyrate. The blank includes panels corresponding to each of the side walls and to the end wall.

Figure 4A:
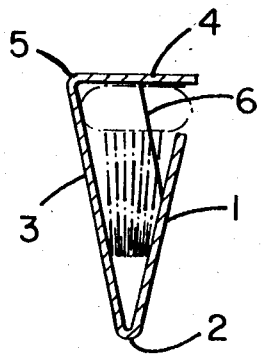
FIG. 4A is transverse section similar to FIG. 4, of a modified form of the toothbrush holder shown in FIG. 2.
Figure 4:
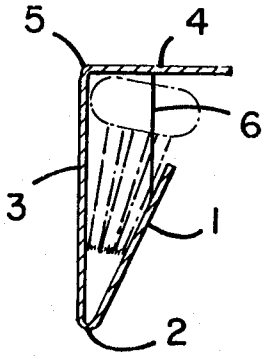
FIG. 4 is a transverse section taken on the line IV—IV of FIG. 2.

With reference to FIG. 4, the final conformation of the bristles of a toothbrush inserted into the toothbrush holder of the present invention is illustrated. It may be seen that the biasing action of the first and second side walls 1, 3, on the sides of the bristles causes the bristles to assume a wedge shape while drying, thereby assuring that no part of the bristles is allowed to distort from its operative shape during drying.

Referring to FIG. 4A, it may be seen that third wall 4 of the toothbrush holder may be bent inwardly with respect to first and second walls 1 and 3. Such an arrangement minimizes twisting of the toothbrush in the holder by providing a uniform contact of wall 4 with the head of the toothbrush, and provides even biasing of the sides of the toothbrush bristles by first and second walls 1 and 3. It will be noted, though, that in such an arrangement, third wall 4 is still substantially normal to second wall 3, within the meaning of 'substantially normal' as used herein.

I claim:

1. A holder for a toothbrush including:

(i) a first substantially rectangular side wall;

(ii) a second substantially rectangular side wall sharing a first common longitudinal edge with the first side wall and angulated thereto, said second side wall being wider than said first side wall; and (iii) a third substantially rectangular side wall sharing a second common longitudinal edge with said second side wall, and extending substantially normal thereto;

said first and second side walls defining therebetween a wedge-shaped chamber adapted to receive the bristles of said toothbrush and to bias the sides of said bristles inwardly whilst said third side wall defines retaining means for retaining said toothbrush in said holder, said bristles upon insertion into said holder thereby forming a wedge-shaped mass whereby they retain their natural operative direction without deformation during drying thereof.

2. A toothbrush holder as claimed in claim 1 further including an end wall normal to said side walls and joined to at least one of said side walls, said end wall defining limiting means to limit the extent of insertion of a toothbrush into a said holder.

3. A toothbrush holder as claimed in claim 2 wherein said first common longitudinal edge is provided with at least one aperture serving as a vent to allow egress of water from said holder.

4. A toothbrush holder as claimed in claim 3, wherein said first and second side walls are angulated to one another at an angle between 15° to 65°.

5. A toothbrush holder as claimed in claim 4, wherein the corner of the first side wall remote from said first common longitudinal edge shared with said second side wall, and said end wall is provided with an upturned lip, said lip serving as means to facilitate insertion of a toothbrush into said holder.

6. A toothbrush holder as claimed in claim 5 wherein said lip is upturned at an angle selected between from 5° to 15°.

7. A toothbrush holder as claimed in claim 5 wherein selected angle is 10°.

8. A toothbrush holder as claimed in claims 4, 6 or 7 wherein said first and second side walls are angulated to one another at a selected angle between from 20° to 45°.

9. A toothbrush holder as claimed in claims 4, 6 or 7 wherein said selected angle is 30°.

10. A one-piece blank adapted to form a toothbrush holder including a plurality of interconnected panels selected ones of which, when the blank is formed to provide said holder, define substantially rectangular first, second and third side walls, each having mutually opposed top and bottom edges and a pair of mutually opposed marginal side edges, said second panel being wider than said first panel and sharing a first common side edge therewith and said second and third panels sharing a second common side edge; said first and second panels, upon bending along said first common side edge, forming a wedge-shaped chamber adapted to receive the bristles of a toothbrush and to bias the sides of said bristles inwardly so as to retain them in a wedge-shaped mass during drying thereof; and said second and third panels, upon bending along said second common side edge, forming a retaining wall extending normal to said second panel and adapted slidably to engage the head of a toothbrush and thereby retain the latter in said holder.

11. A toothbrush holder as claimed in claim 4, 6 or 7 formed from aluminum.

12. A toothbrush holder as claimed in claim 4, 6 or 7 formed from a thermoplastic material selected from the group consisting of high and low density polyethylene, or polypropylene, or acrylonitrile-butadiene-styrene (A.B.S. resin), rubber-modified polystyrene, PVC, cellulose acetate, or cellulose acetate butyrate.

13. A blank as claimed in claim 10 formed from a metallic material selected from the group consisting of aluminum, tin or stainless steel.

14. A blank as claimed in claim 10 formed from a thermoplastic material selected from the group consisting of high and low density polyethylene, or polypropylene, PVC, or acrylonitrile-butadiene-styrene (A.B.S. resin), rubber-modified polystyrene, cellulose acetate, or cellulose acetate butyrate.

* * * * *